US007155844B2

(12) United States Patent
Chu

(10) Patent No.: US 7,155,844 B2
(45) Date of Patent: Jan. 2, 2007

(54) SHOCK-ABSORBING SHOE STRUCTURE HAVING ADJUSTABLE ELASTICITY

(76) Inventor: Yi-Tien Chu, PO Box 82-144, Taipei (TW)

( * ) Notice: Subject to any disclaimer, the term of this patent is extended or adjusted under 35 U.S.C. 154(b) by 280 days.

(21) Appl. No.: 10/960,949

(22) Filed: Oct. 12, 2004

(65) Prior Publication Data

US 2006/0075657 A1 Apr. 13, 2006

(51) Int. Cl.
*A43B 21/30* (2006.01)
*A43B 13/18* (2006.01)

(52) U.S. Cl. ..... 36/28; 36/35 R; 36/37

(58) Field of Classification Search ..... 36/27, 36/28, 35 R, 37, 25 R
See application file for complete search history.

(56) References Cited

U.S. PATENT DOCUMENTS 4,391,048 A * 7/1983 Lutz ..... 36/28
5,596,819 A * 1/1997 Goldston et al. ..... 36/35 R
5,778,560 A * 7/1998 Danieli ..... 36/35 R
5,797,198 A * 8/1998 Pomerantz ..... 36/27
6,131,309 A * 10/2000 Walsh ..... 36/28
6,405,455 B1 * 6/2002 Walsh ..... 36/28
6,553,692 B1 * 4/2003 Chung ..... 36/37
6,807,753 B1 * 10/2004 Steszyn et al. ..... 36/28
6,901,686 B1 * 6/2005 Hayes ..... 36/27
2002/0184792 A1 * 12/2002 Sugawara ..... 36/28
2003/0208928 A1 * 11/2003 Steszyn et al. ..... 36/28
2004/0148799 A1 * 8/2004 Lussier et al. ..... 36/28

* cited by examiner

*Primary Examiner*—Marie Patterson
(74) *Attorney, Agent, or Firm*—Leong C. Lei

(57) ABSTRACT

A shock-absorbing shoe structure having adjustable elasticity is disclosed. The shoe structure includes a buffering mechanism having a bottom holding plate, a buffering module, and a top holding plate. The buffering module includes a base seat, an elastic tube body, an end mount, a connection element, a pivotal seat, a rotating button, a securing screw rod, a top swinging arm, and a bottom-swinging arm. By rotating the rotating button, the elastic tube body is compressed and released via a connection element. Thus, the elasticity and the buffering effect of the shoe can be adjusted.

3 Claims, 7 Drawing Sheets

SHOCK-ABSORBING SHOE STRUCTURE HAVING ADJUSTABLE ELASTICITY

BACKGROUND OF THE INVENTION (a) Technical Field of the Invention

The present invention relates to a shock-absorbing shoe structure, and in particular, a shoe structure for which its elasticity is adjustable by rotating a button so as to compress or release the elastic tubular body via a connecting element.

(b) Description of the Prior Art

Recently available shock-absorbing shoes have a buffering device at the shoe bottom. This buffering device includes rubber, air sacs, and water sacs. These buffering devices have the advantages of low cost and simple in structure, but the elasticity is limited. Accordingly, it is an object of the present invention to provide a shock-absorbing shoe structure having adjustable elasticity, which can overcome the above drawbacks.

SUMMARY OF THE INVENTION

Accordingly, it is an object of the present invention to provide a shock-absorbing shoe structure having adjustable elasticity comprising a shoe body, a shoe bottom and a head section mounted with a buffering mechanism, characterized in that the buffering mechanism includes a bottom holding plate, a buffering module and a top actuating plate; the front end of the bottom holding plate has a shaft hole, and the middle section has a notch, and the rear section is a horizontal shaft having a shaft hole, the top actuating plate corresponds to the bottom holding plate, and the front end of the top actuating plate has a shaft hole, and the middle section has a notch, and the rear section is a horizontal shaft having a shaft hole; the buffering module includes a base seat, an elastic tube body, an end mount, a connection element, a pivot seat, a rotating button, a securing screw rod, a top swinging arm and a bottom swinging arm and the rear end of the base seat is a tube section with a shaft hole, the center of the front section is an insertion peg having a thread hole, the elastic tube body is a cylindrical tubular section, and the end mount has threaded screw hole, and the rear end is an insertion peg; the center of the connection element has a non-circular hole and the rear section thereof is a tapered threaded section; the pivot seat has a through hole having two sides mounted with a cylindrical section; the rotating button has a through hole at the center thereof and the middle section thereof has a protruded edge, and the rear end is a non-circular male peg; the top swinging arm and the bottom swinging arm have a through hole and a shaft hole, thereby the rotating of the rotating button compresses or releases the elastic tube body via the connection element, and the elasticity of the shoe structure is thus adjusted.

Still another object of the present invention is to provide a shock-absorbing shoe structure having adjustable elasticity, wherein the elasticity of the shoe is adjustable using a rotating button.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
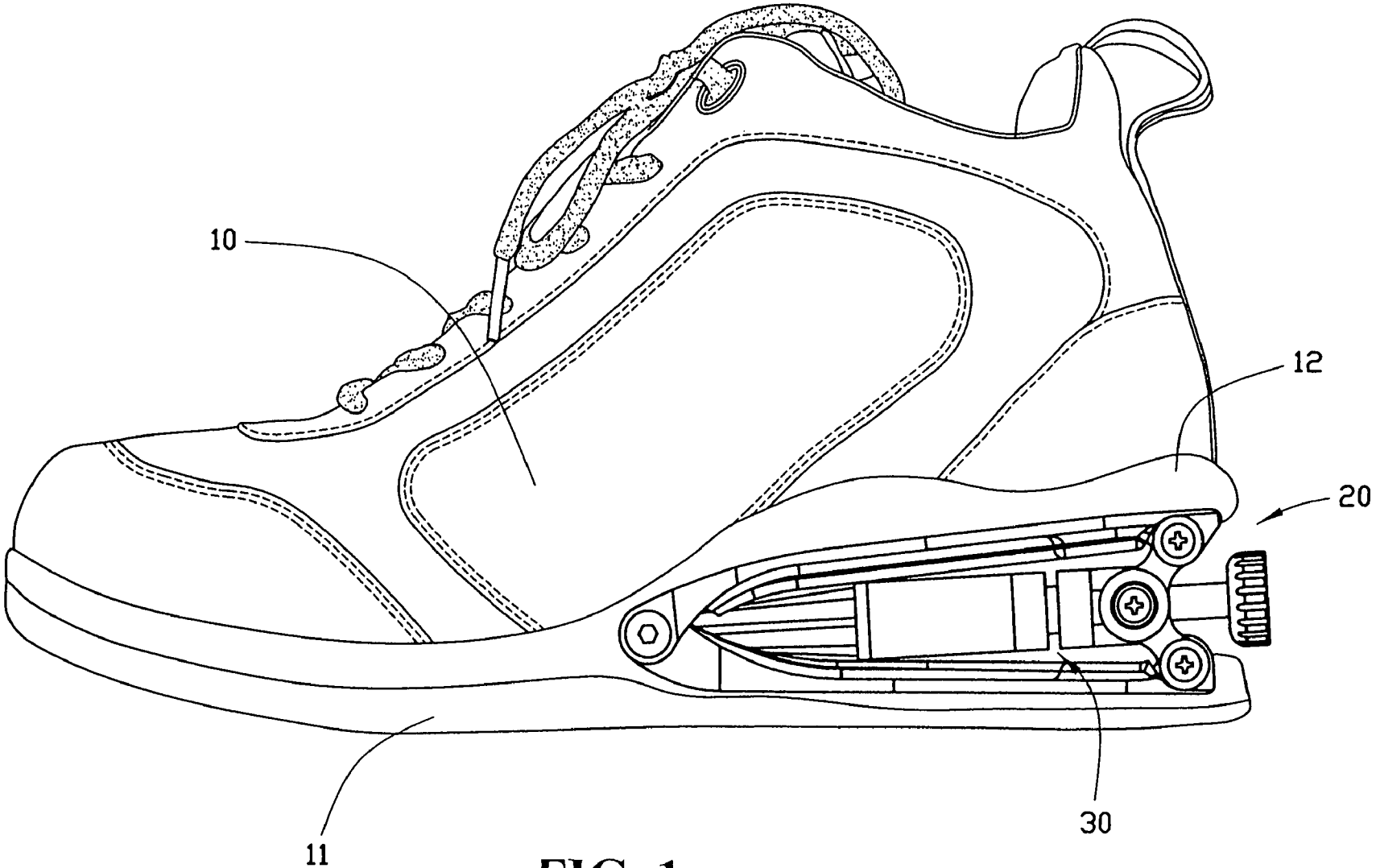
FIG. 1 is a combination drawing of the shoe structure in accordance with the present invention.
Figure 2:
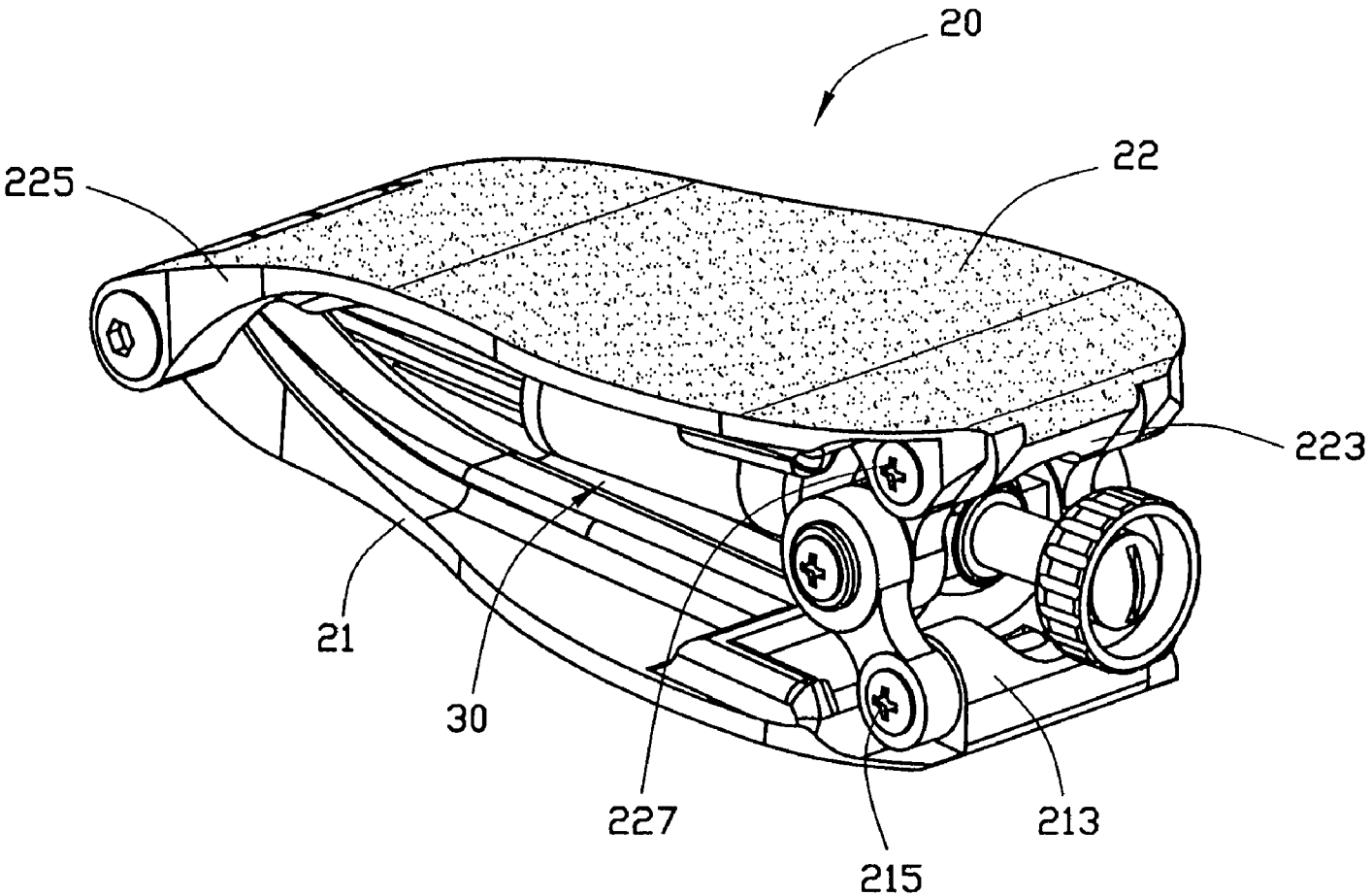
FIG. 2 is a perspective view of the buffering mechanism of the present invention.
Figure 3:
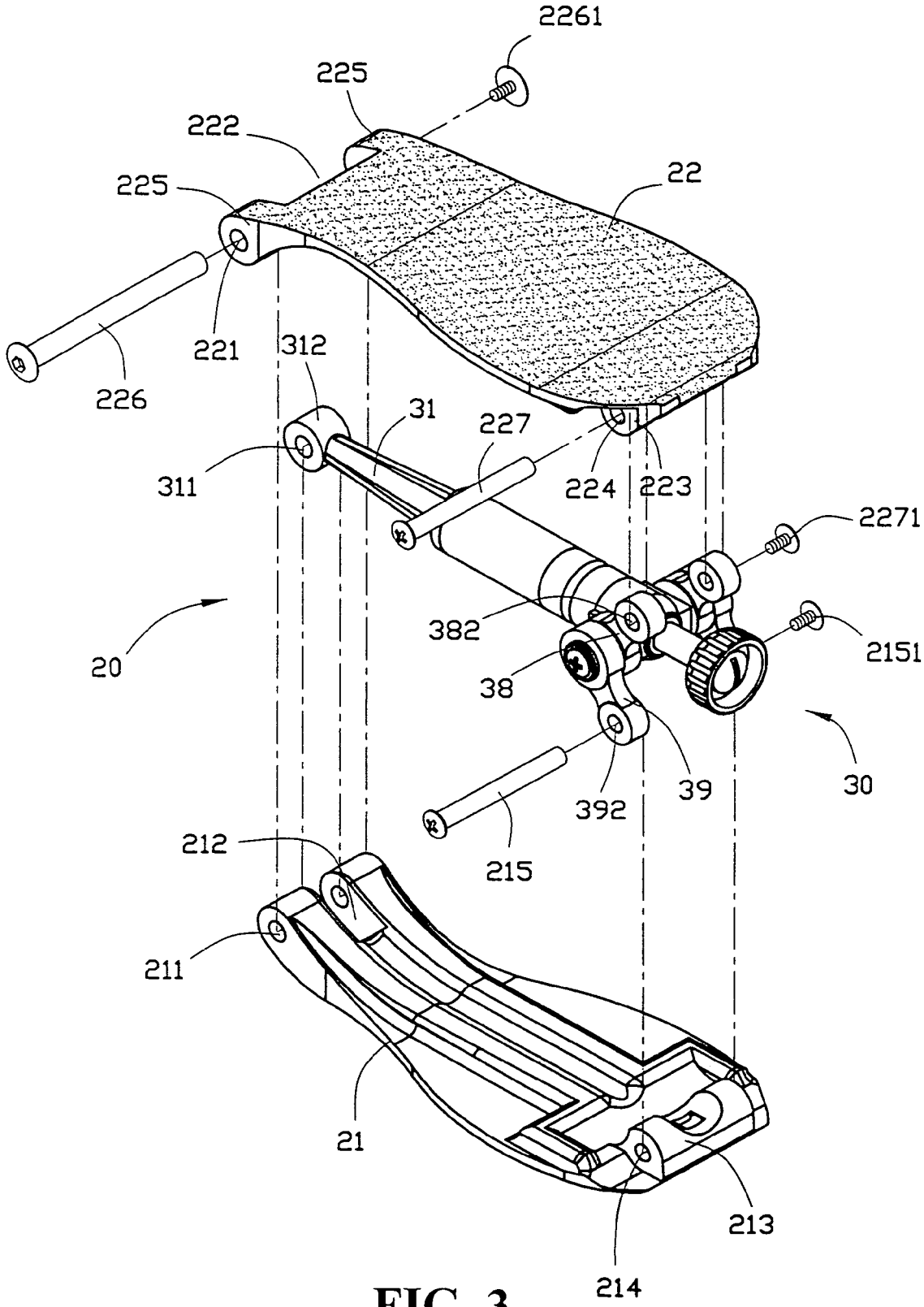
FIG. 3 is a perspective exploded view of the buffering mechanism in accordance with the present invention.
Figure 4:
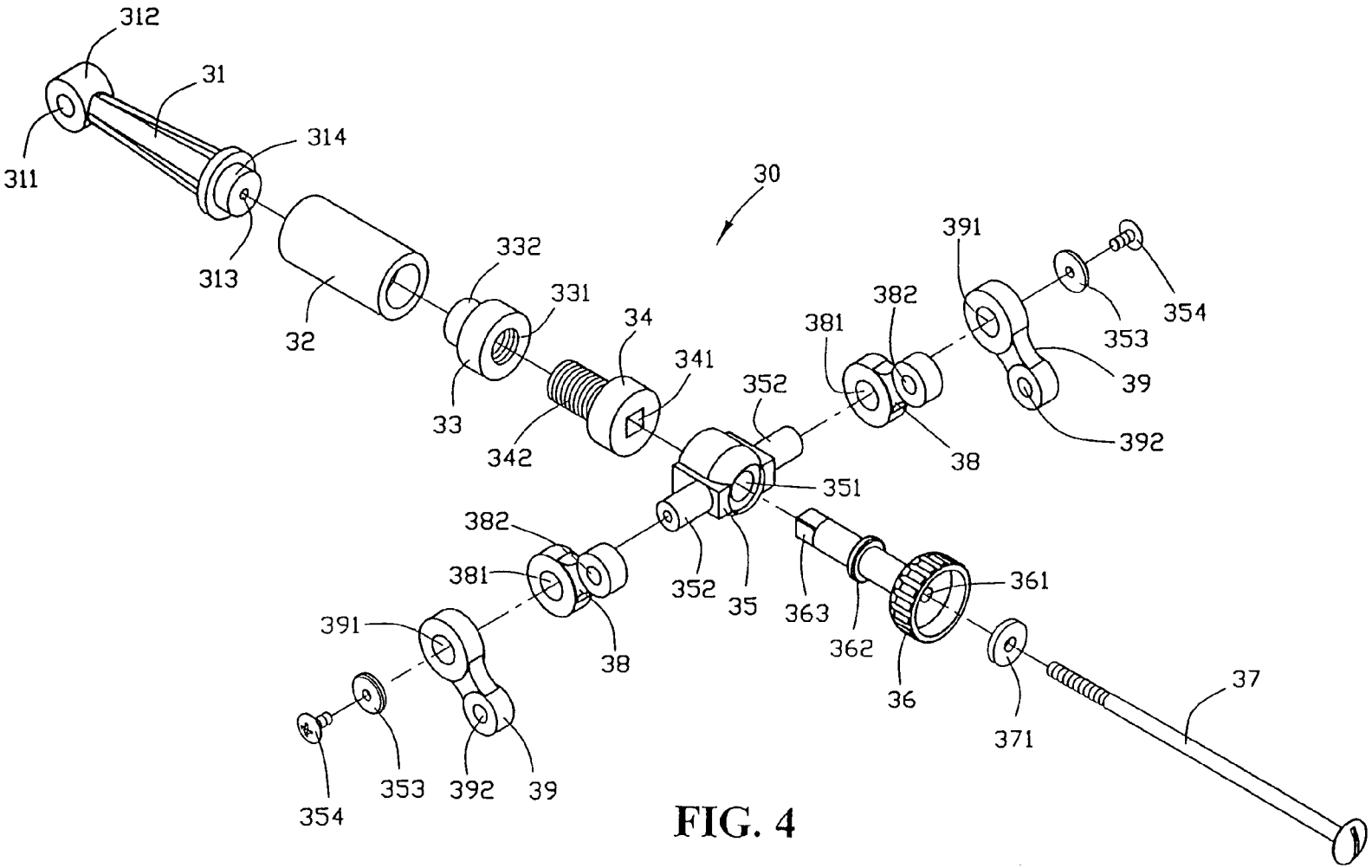
FIG. 4 is a perspective exploded view of the buffering device of the present invention.

Referring to FIG. 1, there is shown a shock-absorbing shoe structure having adjustable elasticity comprising a shoe body 10, a shoe bottom 11 and a heel section 12 mounted with a buffering mechanism 20. As shown in FIGS. 2, 3, and 4, the buffering mechanism 20 includes a bottom holding plate 21, a buffering module 30 and a top actuating plate 22. The front end of the bottom holding plate 21 has a shaft hole 211 in radial direction, and the middle section of the bottom holding plate 21 has a notch 212, and the rear section of the bottom holding plate 21 is a protruded horizontal shaft 213 having a radial shaft hole 214. The top actuating plate 22 is corresponding to the bottom holding plate 21. The front end of the top actuating plate 22 has a shaft hole 221, and the middle section has a notch 222. The rear section of the top actuating plate 22 is a horizontal shaft 223 having a shaft hole 224.

Figure 5:
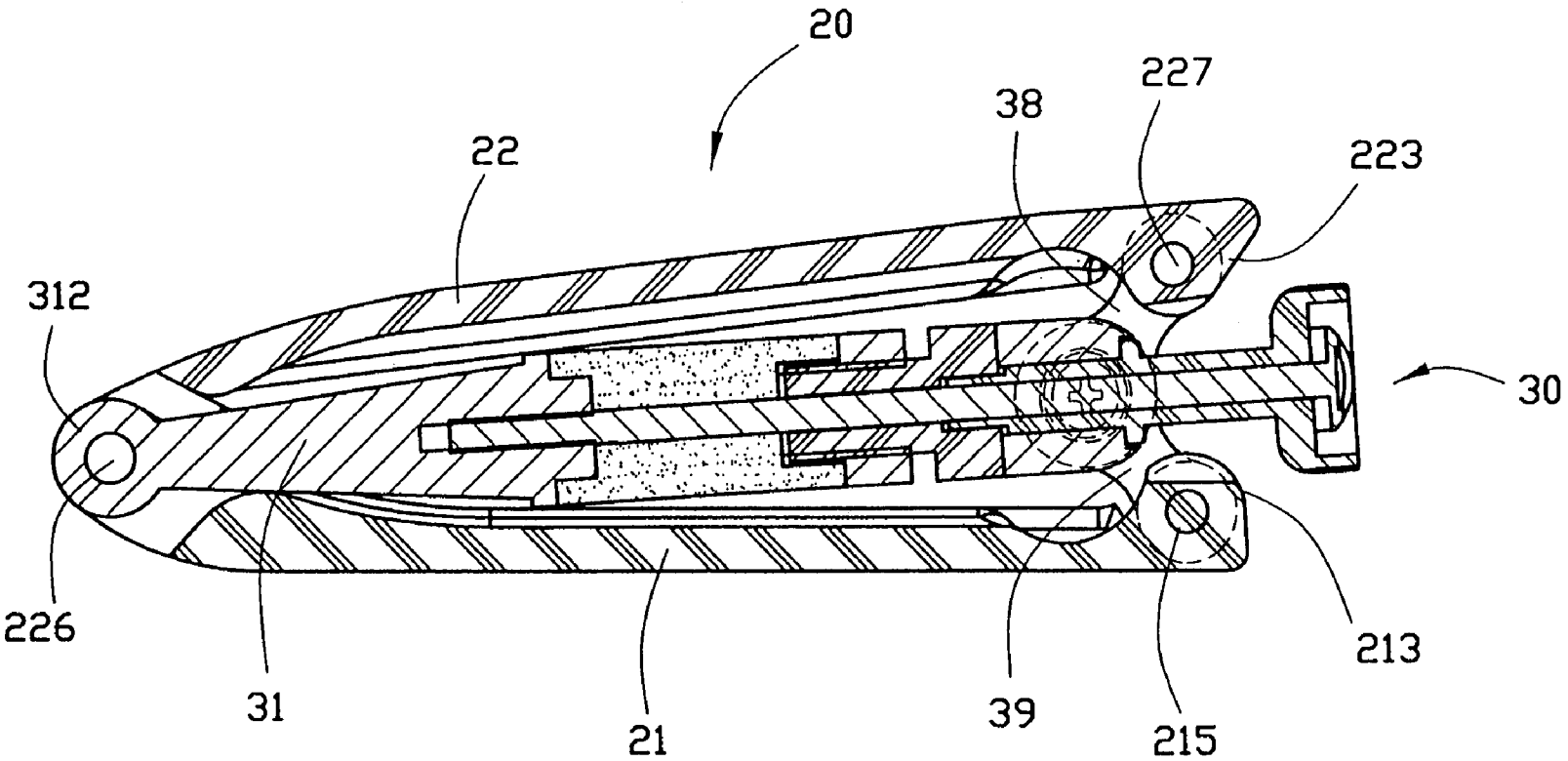
FIG. 5 is a sectional view of the buffering mechanism of the present invention.

Referring to FIG. 3 and FIG. 5, the radial tube section 312 of the base seat 31 of the buffering module 30 is mounted to the notch 212 at the front end of the bottom holding plate 21 with the buffering mechanism 20. The lug 225 of the top actuating plate 22 is engaged at the two sides of the front end of the bottom holding plate 21, and a peg 226 passed through the shaft hole 221 of the top actuating plate 22, the radial hole 211 of the bottom holding plate 21, and the shaft hole 311 of the base seat 31. Thus, the buffering module 30 is pivotally mounted to the abdomen section of the bottom holding plate 21 and the top actuating plate 22. Further, a bottom peg 215 passes through the shaft hole 392 of the bottom swinging arm 39, the shaft hole 214 of the rear section horizontal shaft 213 of the bottom holding plate 21 in sequence. Thus, the bottom-swinging arm 39 at the two sides of the buttering module 30 is pivoted to the horizontal shaft 223 of the top actuating plate 22. The top peg 227 passes through the shaft hole 224, the shaft hole 382 and the shaft hole 382 of the top-swinging arm 38 of the buffering module 30. Thus the top-swinging arm 38 at the two sides of the buffering module 30 is mounted to the horizontal shaft 223 of the top actuating plate 22.

As shown in FIG. 4, the buffering module 30 includes a base seat 31, an elastic tube body 32, an end mount 33, a connection element 34, a pivot seat 35, a rotating button 36, a securing screw rod 37, a top swinging arm 38 and a bottom swinging arm 39, and the rear end of the base seat 31 is a tubular section with a tube section 312 having a shaft hole 311, and the center of the front section is an insertion peg 314 having a thread hole 313.

The elastic tube body 32 is a cylindrical tubular section made from elastic rubber or plastic material, or compression spring, and the end mount 33 has threaded screw hole 331, and the rear end is an insertion peg 332. The center of the connection element 34 has a non-circular hole 341 and the rear section 342 thereof is a tapered threaded section. The pivot seat 35 has a through hole 351 having two sides correspondingly mounted with a cylindrical section 352.

The rotating button 36 has a through hole 361 at the center thereof and the middle section thereof has a protruded edge 362, and the rear end is a non-circular male peg 363. The top swinging arm 38 and the bottom-swinging arm 39 are respectively provided with through holes 381, 391 and shaft holes 382, 392.

In combination of the buffering module 30, the end mount 33 and the connection element 34 are locked together, and a pad 371 and a securing screw rod 37 connect the rotating button 36, the pivot seat 35, the connection element 34, the end mount 33 and the elastic tube body 32 in sequence to the end position of the insertion peg 314 of the base seat 31. After that the two sides of the cylindrical post 352 of the pivot seat 35 are respectively mounted with a top swinging arm 38 and the bottom swinging arm 39, and subsequently, the pad 353 and a screw 354 are used for locking.

After the combination of the shaft peg 226, the bottom peg 215, and the top peg 227 are locked with screws 2261, 2151, 2271, or by riveting.

Figure 6:
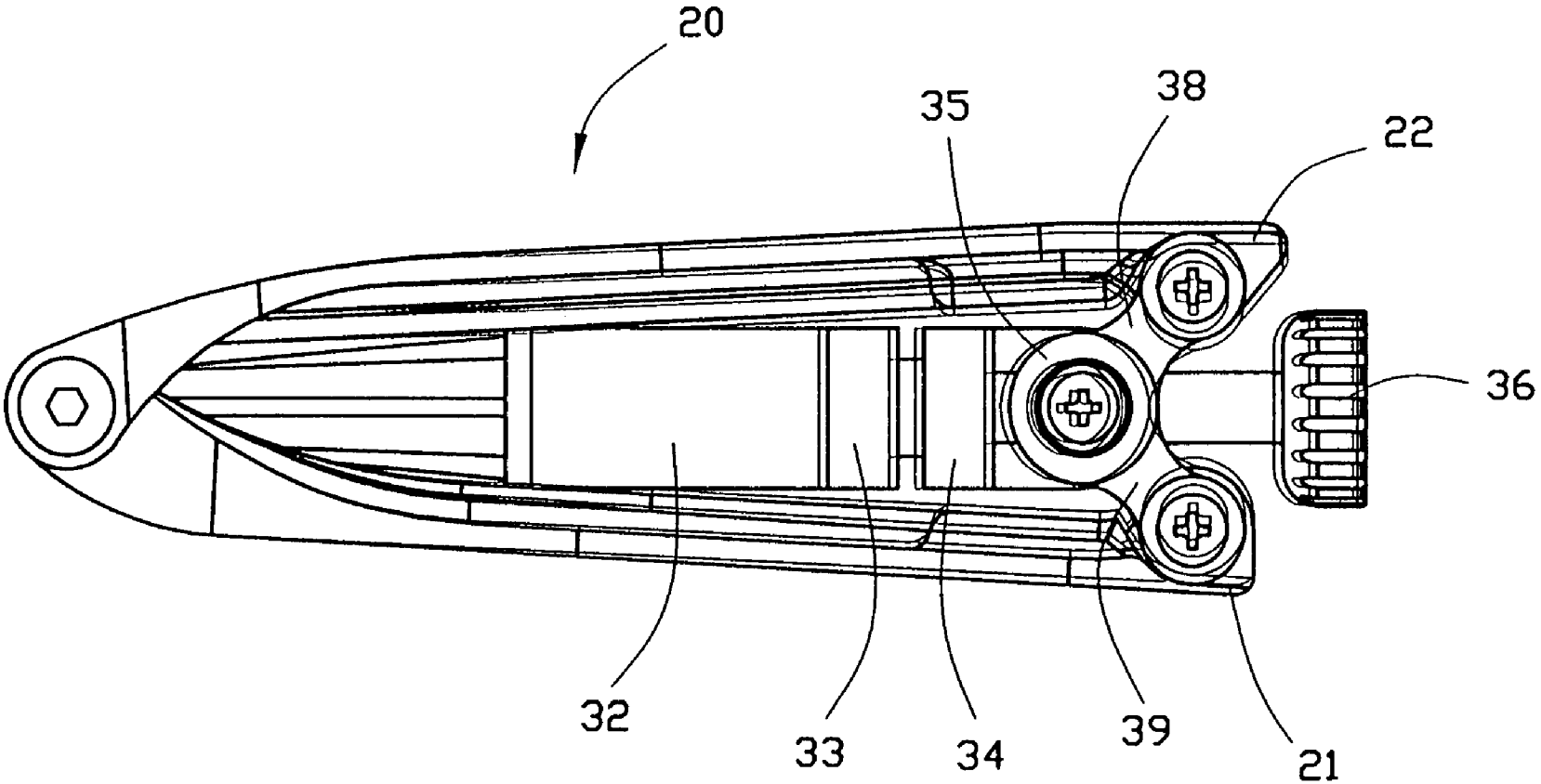
FIG. 6 is a schematic view of the tightening mechanism of the buffering mechanism of the present invention.

In operation, as shown in FIGS. 1, 4, and 6, the rotating button 36 is rotated counter-clockwise direction, and the non-circular male peg 363 at the front end of the button 36 interlinks the connection element 34. The threaded section 342 moves forward to push the end mount 33 to compress the elastic tube 32. This will enhance the buffering elasticity of the elastic body 32. When the button 36 is rotated in a counterclockwise direction, the connection element 34 pushes backward the pivot seat 35, and then pushes the top and bottom swinging arm 38, 39 to extend the top holding plate 21 and the top actuating plate 22 with the circular post 352 of the pivot seat 35 as a support. The heel section 12 of the shoe body 10 is extended. Thus the elasticity and buffering effect of the shoe body 10 are enhanced.

Figure 7:
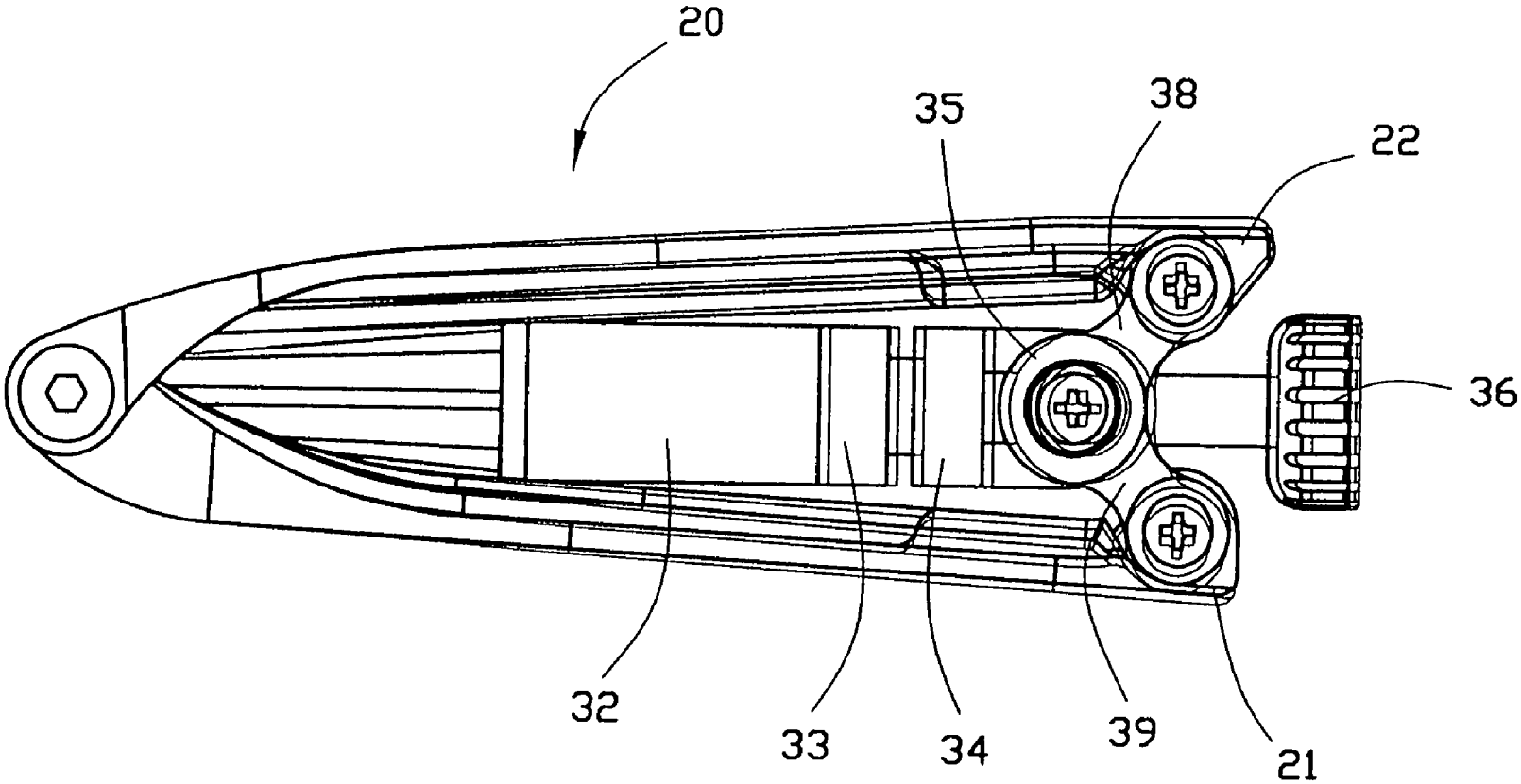
FIG. 7 is a schematic view of the loosening mechanism of the buffering mechanism of the present invention.

If the buffering mechanism 20 is to be loosely adjusted, as shown in FIGS. 1, 4, and 7, the button 36 rotates in a clockwise direction, and the non-circular male peg 363 interlinks the connection element 34, and the threaded section 342 tightens the end mount 33 to gradually release the elastic tube body 32. This will reduce the buffering elasticity f the elastic tube body 32. The protruded edge 362 of the rotating button 36 pushes forward the pivot seat 35, and the cylindrical post 352 of the pivot seat 35 is a support so as to push the top and bottom swinging arm 38, 39 to retract the bottom holding plate 21 and the top actuating plate 22. That is the heel section 12 of the shoe body 10 is contracted, and the elasticity and the buffering effect of the shoe body 10 are reduced.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A shock-absorbing shoe structure having adjustable elasticity comprising a shoe body, a shoe bottom and a head section mounted with a buffering mechanism, characterized in that the buffering mechanism includes a bottom holding plate, a buffering module and a top actuating plate; the front end of the bottom holding plate has a shaft hole, and the middle section has a notch, and the rear section is a horizontal shaft having a shaft hole, the top actuating plate corresponds to the bottom holding plate, and the front end of the top actuating plate has a shaft hole, and the middle section has a notch, and the rear section is a horizontal shaft having a shaft hole; the buffering module includes a base seat, an elastic tube body, an end mount, a connection element, a pivot seat, a rotating button, a securing screw rod, a top swinging arm and a bottom swinging arm and the rear end of the base seat is a tube section with a shaft hole, the center of the front section is an insertion peg having a thread hole, the elastic tube body is a cylindrical tubular section, and the end mount has threaded screw hole, and the rear end is an insertion peg; the center of the connection element has a non-circular hole and the rear section thereof is a tapered threaded section; the pivot seat has a through hole having two sides mounted with a cylindrical section; the rotating button has a through hole at the center thereof and the middle section thereof has a protruded edge, and the rear end is a non-circular male peg; the top swinging arm and the bottom swinging arm have a through hole and a shaft hole, thereby the rotating of the rotating button compresses or releases the elastic tube body via the connection element, and the elasticity of the shoe structure is thus adjusted.

2. The shock-absorbing shoe structure of claim 1, wherein the elastic tube body is made from a rubber material with elasticity or elastic plastic material with elasticity or compression springs formed into a cylindrical tube.

3. The shock-absorbing shoe structure of claim 1, wherein a shaft peg, a bottom shaft peg and a top shaft peg are combined and are secured using screw or riveted.

* * * * *